US010864126B2

(12) United States Patent
Uddeskär et al.

(10) Patent No.: US 10,864,126 B2
(45) Date of Patent: Dec. 15, 2020

(54) PATIENT HANDLING DEVICES

(71) Applicant: Liko Research & Development AB, Lulea (SE)

(72) Inventors: Sandra Uddeskär, Lulea (SE); Clementine Pirio, Nantes (FR); Andreas Bolin, Gammelstad (SE); Joakim Eriksson, Lulea (SE); Peter Rydstrom, Gammelstad (SE); Elin Dovervik, Lulea (SE)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 217 days.

(21) Appl. No.: 16/030,889

(22) Filed: Jul. 10, 2018

(65) Prior Publication Data

US 2019/0015269 A1 Jan. 17, 2019

Related U.S. Application Data

(60) Provisional application No. 62/530,879, filed on Jul. 11, 2017.

(51) Int. Cl.

| | |
|---|---|
| ***A61G 1/013*** | (2006.01) |
| ***A61G 1/04*** | (2006.01) |
| ***A61G 1/02*** | (2006.01) |
| ***A61G 1/003*** | (2006.01) |
| ***A61G 7/10*** | (2006.01) |

(Continued)

(52) U.S. Cl.

CPC ..... *A61G 1/013* (2013.01); *A61G 1/003* (2013.01); *A61G 1/0293* (2013.01); *A61G 1/042* (2016.11); *A61G 7/1017* (2013.01); *A61G 7/1046* (2013.01); *A61G 7/1055* (2013.01); *A61G 7/1057* (2013.01); *A61G 7/1076* (2013.01); *A61G 7/1086* (2013.01); *A61G 7/1096* (2013.01); *A61G 7/16* (2013.01); *A61G 7/0514* (2016.11); *A61G 7/0518* (2016.11)

(58) Field of Classification Search

CPC ..... A61G 1/013; A61G 1/042; A61G 1/0293; A61G 1/003; A61G 7/1076; A61G 7/1055; A61G 7/1046; A61G 7/1017; A61G 7/1086; A61G 7/1057; A61G 7/1096; A61G 7/16; A61G 7/0514; A61G 7/0518

See application file for complete search history.

(56) References Cited

U.S. PATENT DOCUMENTS 1,961,119 A * 5/1934 Ettinger ..... A61G 7/1015 5/89.1

7,578,012 B2 * 8/2009 Palay ..... A61G 3/02 5/81.1 R (Continued)

*Primary Examiner* — Eric J Kurilla
*Assistant Examiner* — James T Coble
(74) *Attorney, Agent, or Firm* — Dinsmore & Shohl LLP

(57) ABSTRACT

Patient handling devices for transporting patients in health care settings are disclosed herein. The patient handling devices may include a support member and a torso support member. The patient handling device includes at least one articulating joint that is coupled to the support member and the torso support member. The articulating joint is selectable to arrest or allow articulation of the respective torso support member or the lower extremities support member relative to the support member through a variety of orientations.

19 Claims, 8 Drawing Sheets

(51) Int. Cl.
*A61G 7/16* (2006.01)
*A61G 7/05* (2006.01)

(56) References Cited

U.S. PATENT DOCUMENTS

| | | | | |
|---|---|---|---|---|
| 7,631,575 | B2 * | 12/2009 | Gard | F16C 11/10 74/530 |
| 2003/0024079 | A1 * | 2/2003 | Morita | A45C 13/1069 24/303 |
| 2009/0113633 | A1 * | 5/2009 | Hayes | A61G 7/0507 5/619 |
| 2015/0121987 | A1 * | 5/2015 | Flynn | B21D 37/14 72/481.8 |

* cited by examiner

PATIENT HANDLING DEVICES

CROSS-REFERENCE TO RELATED APPLICATIONS

The present application claims the benefit of U.S. Provisional Application No. 62/530,879 titled "Patient Handling Devices" and filed Jul. 11, 2017.

BACKGROUND

The present disclosure relates to patient handling devices, and, more specifically, to patient handling devices having support members that may be articulated through a variety of positions.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Patient handling devices for transporting patients in health care settings are disclosed herein. The patient handling devices may include a support member, a torso support member, and a lower extremities support member. The patient handling device includes at least one articulating joint that is coupled to the support member and the torso support member and at least one articulating joint that is coupled to the support member and the lower extremities support member. The articulating joints are selectable to arrest or allow articulation of the respective torso support member or the lower extremities support member relative to the support member through a variety of angles. These and other elements will be discussed in further detail below.

In health care settings, it is often necessary to reposition patients between locations or to change the patient's posture. Such patient repositioning has previously been accomplished using slings, which are positioned beneath a patient. The patient is subsequently lifted and moved to a different location or changed to a different posture. However, positioning the patient in the sling may be complicated, as the sling must be positioned entirely around the patient's body to ensure that lifting forces are well distributed. Further, the slings are not designed to accommodate patients in a variety of positions. Instead, each patient position necessitates a different sling design.

The present disclosure is directed to patient handling device that include a plurality of support members that can be positioned and oriented relative to one another to support a patient across a variety of positions. The proximate support members may be coupled to one another by articulating joints. The articulating joints may selectively allow articulation of the support members to which they are coupled so that the support members may be positioned to accommodate patients across a variety of postures. The articulating joints may be selectable to be arrested or allowed to rotate such that the patient handling device can be articulated on demand, yet continue to support the patient in a predetermined posture once the patient is supported by the patient handling device.

Because the patient handling device may be selected to be generally rigid, the patient handling device may support a patient without having to envelop the patient in a sling. Further, the patient may be positioned onto the patient handling device using techniques that are relatively benign to the patient.

The patient handling device may be incorporated into a patient handling system that also includes a patient lifting device. The patient lifting device may provide support to the patient handling device to support the patient and the patient handling device during a patient transfer operation. The patient lifting device may include a mobile lift or a hoist. The patient lifting may allow a caregiver to move a patient in a comfortable posture.

Figure 1:
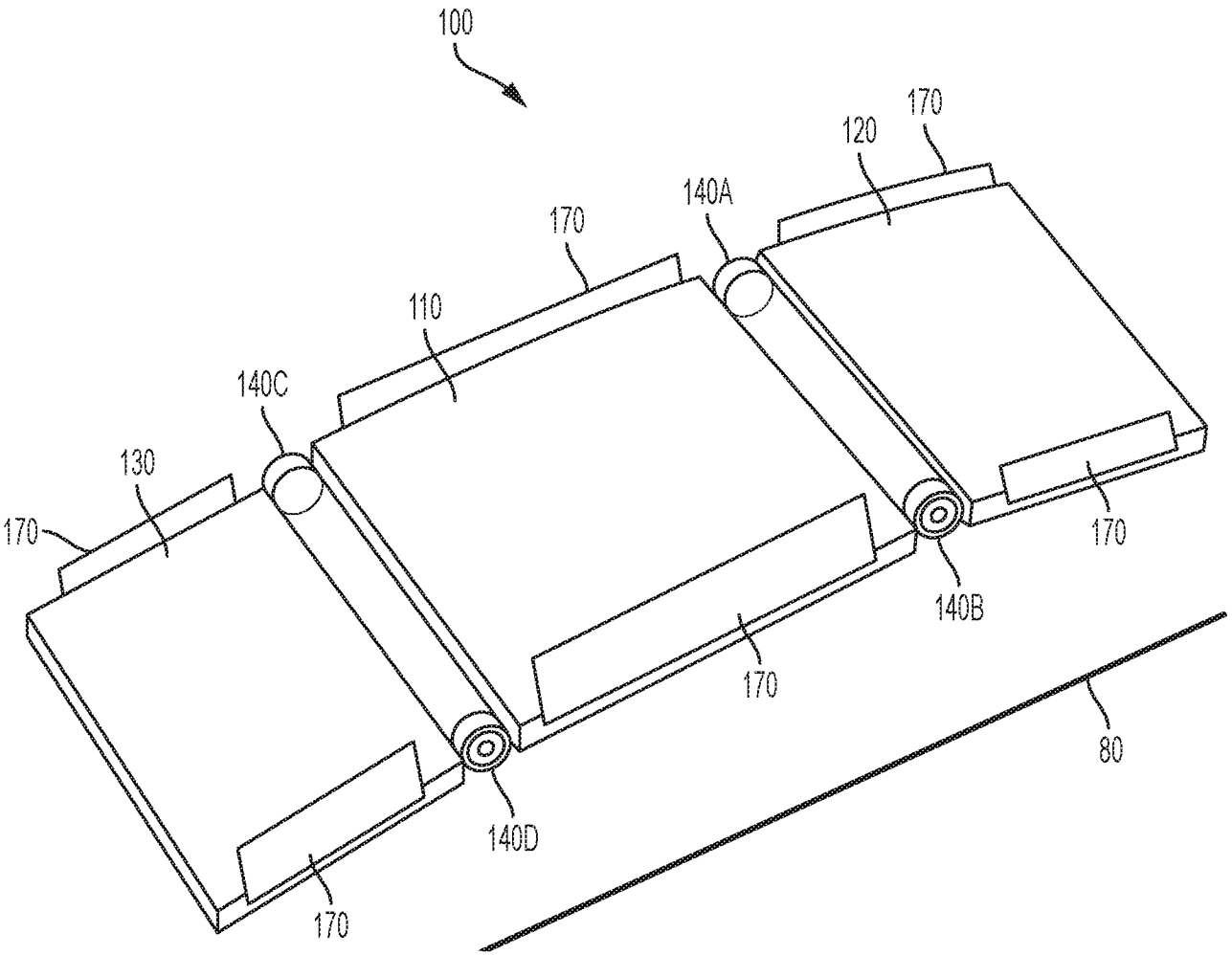
FIG. 1 is a side perspective view of a patient handling device according to one or more embodiments shown or described herein.

Referring now to FIG. 1, a patient handling device 100 is depicted. In the depicted embodiment, the patient handling device 100 includes a support member 110, a torso support member 120, and a lower extremities support member 130. The support member 110 and the torso support member 120 are coupled to one another by articulating joints 140A, 140B. The support member 110 and the lower extremities support member 130 are couple to one another by articulating joints 140C, 140D. The articulating joints 140 are selectable to arrest or allow articulation of the respective torso support member 120 or the lower extremities support member 130 relative to the support member 110.

The support member 110, the torso support member 120, and the lower extremities support member 130 may include generally rigid bodies that exhibit strength and stiffness to be used repeatedly and for an extended duration in a health care environment. In some embodiments, the support member 110, the torso support member 120, and the lower extremities support member 130 may be made from a metal structure, a plastic structure, a composite structure of plastic and a reinforcement material, such as fiberglass, or a wood structure. In various embodiments, the support member 110, the torso support member 120, and the lower extremities support member 130 may include padding (not shown) to improve the comfort of the patient handling device 100 and reduce pressure between the patient handling device 100 and the patient's body tissues.

Figure 2:
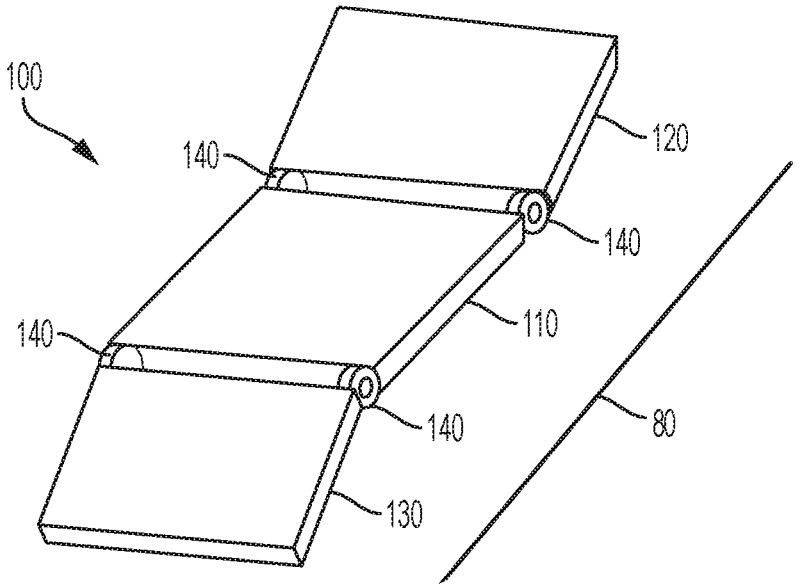
FIG. 2 is a side perspective view of a patient handling device according to one or more embodiments shown or described herein.
Figure 3:
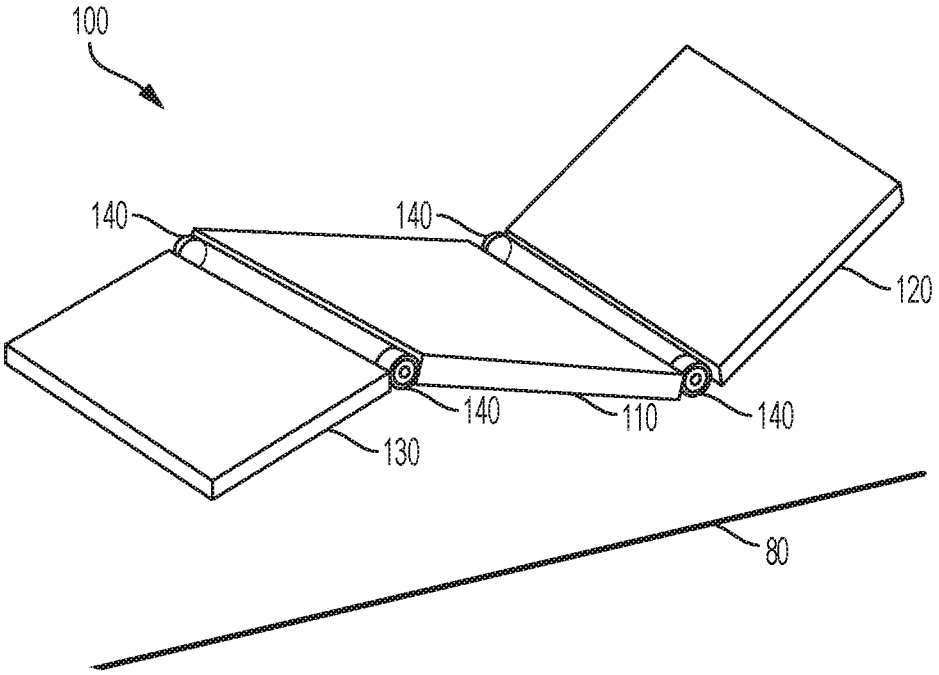
FIG. 3 is a side perspective view of a patient handling device according to one or more embodiments shown or described herein.

Referring collectively to FIGS. 1-3, the patient handling device 100 may be positioned across a variety of orientations that generally correspond to postures of the patient. In FIG. 1, a flat orientation of the patient handling device 100 is depicted, which corresponds to a patient being in a supine position, and in which all of the support member 110, the torso support member 120, and the lower extremities support member 130 are generally parallel with a ground surface 80. In FIG. 2, the patient handling device 100 is oriented to accommodate a patient who is in an upright seated position, such that the support member 110 is generally parallel with the ground surface 80 and the torso support member 120 and the lower extremities support member 130 are transverse to the ground surface 80. In FIG. 3, the patient handling device 100 is oriented to accommodate a patient who is in a reclined seated position, such that all of the support member 110, the torso support member 120, and the lower extremities support member 130 are transverse to the ground surface 80.

The patient handling device 100 may be selectively oriented to generally match the patient's posture prior to the patient being placed on the patient handling device 100. In some embodiments, the patient handling device 100 may be re-oriented while the patient is positioned on the patient handling device 100 to allow the patient's posture to be adjusted when the patient is moved from location to location.

Referring again to FIG. 1, embodiments of the patient handling device 100 may include side supports 170 that are coupled to at least one of the support member 110, the torso support member 120, or the lower extremities support member 130. In some embodiments, the patient handling device 100 may include a plurality of sets of side supports 170, each of which are coupled to one of the support member 110, the torso support member 120, and the lower extremities support member 130. By incorporating multiple sets of side supports 170, the side supports 170 may be configured to maintain the position of the patient through a variety of postures. The side supports 170 may be selectively positioned or removed during a patient ingress or egress operation to provide the patient with ease of access to the support member 110, the torso support member 120, and the lower extremities support member 130 of the patient handling device 100.

In various embodiments, the support member 110, the torso support member 120, and the lower extremities support member 130 may be separable from one another, such that the patient handling device 100 is modular. In various healthcare applications, it may be easier to position the individual support member 110, torso support member 120, and lower extremities support member 130 beneath a patient while the patient is lying in a supine position. Once the support member 110, the torso support member 120, and the lower extremities support member 130 are positioned below the patient, the support member 110, the torso support member 120, and the lower extremities support member 130 may be coupled to one another, thereby forming the integral patient handling device 100. In various embodiments, the articulating joints 140 and the adjoining support member 110, the torso support member 120, and the lower extremities support member 130 may include selectively lockable elements that allow the separation and attachment of the adjoining elements, as needed by the caregiver.

Figure 4:
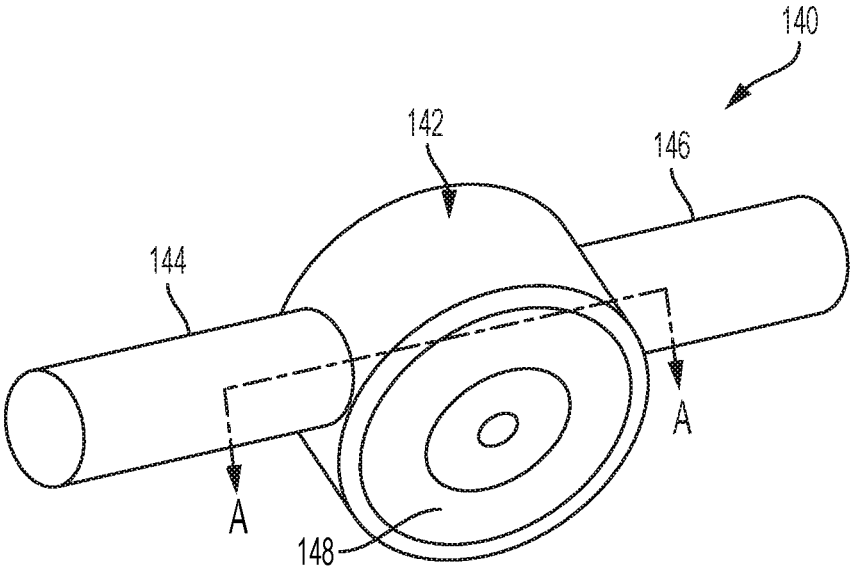
FIG. 4 is a side perspective view of an articulating joint for a patient handling device according to one or more embodiments shown or described herein.

Referring now to FIG. 4, one embodiment of an articulating joint 140 is depicted. In the depicted embodiment, the articulating joint 140 includes a selectively locking hub 142, a first attachment beam 144 that extends from the selectively locking hub 142, and a second attachment beam 146 that extends from the selectively locking hub 142. In embodiments of the patient handling device, the articulating joints 140 throughout the patient handling device may be the same as one another.

The articulating joints 140 may be selectable to arrest or allow articulation of the first attachment beam 144 relative to the second attachment beam 146. The articulating joints 140 may include a delocking element 148 that a user may selectively actuate to disengage the arresting element and allow the articulating joint 140 to articulate. The articulating joints 140 may include a variety of mechanism in the selectively locking hub 142 to provide this selective arresting or allowing of articulation. In some embodiments, the selectively locking hub 142 allows articulation of the first attachment beam 144 relative to the second attachment beam 146 at a plurality of predetermined orientations. In other embodiments, the selectively locking hub 142 allows articulation of the first attachment beam 144 relative to the second attachment beam 146 through a range of motion without predetermined orientations.

Figure 5:
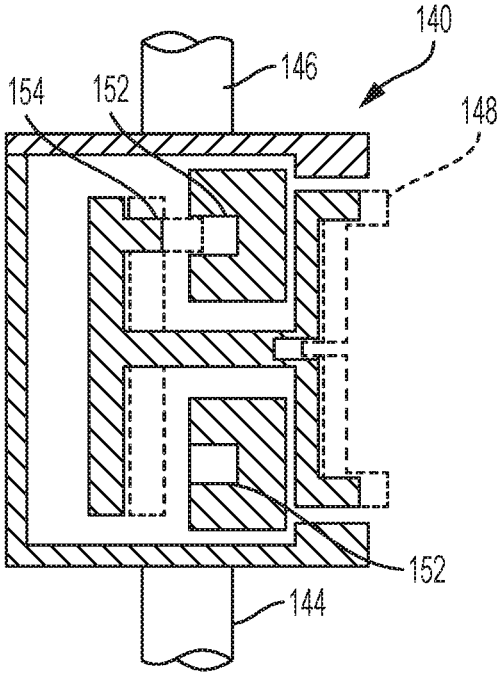
FIG. 5 is a top sectional view of the articulating joint of FIG. 4 shown alone line A-A.

Referring now to FIG. 5, one embodiment of the articulating joint 140 having a plurality of detents 152 and a catch 154 are depicted. In this embodiment, the catch 154 may be selectively decoupled from the detents 152, thereby allowing the first attachment beam 144 to be articulated freely relative to the second attachment beam 146. The catch 154 may be released and may interface with one of the plurality of detents 152, thereby selectively coupling the catch 154 with the detent 152 and arresting articulation of the first attachment beam 144 relative to the second attachment beam 146 at a plurality of predetermined orientations. While only two detents 152 are depicted in the figure because of the section cut, it should be understood that a plurality of detents may be included in the articulating joint 140.

Figure 6:
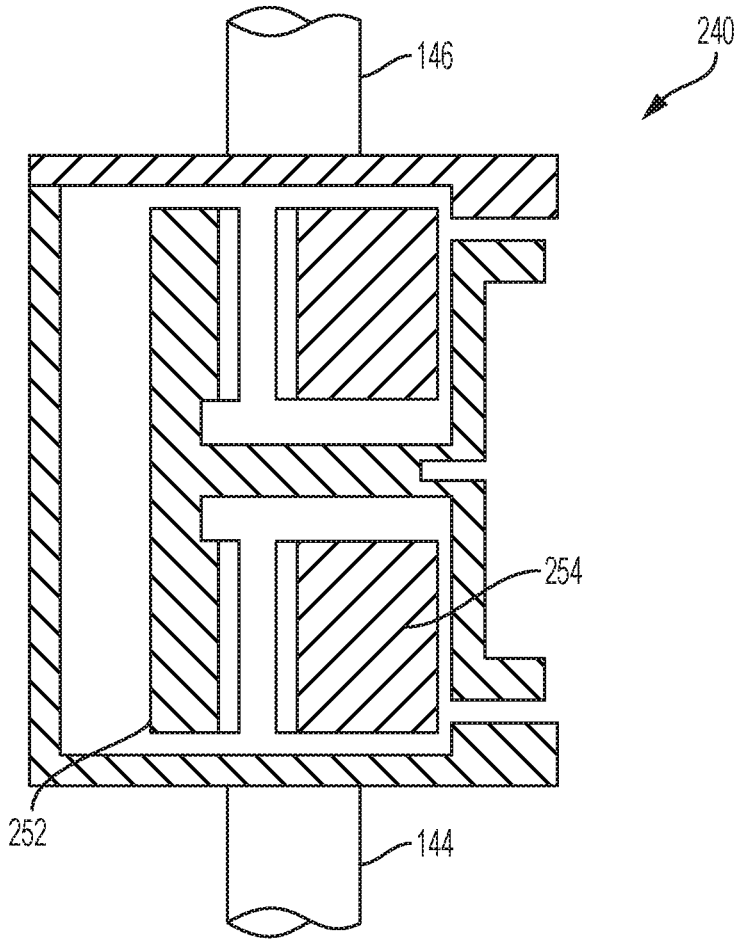
FIG. 6 is a top sectional view of the articulating joint of FIG. 4 shown alone line A-A.

Referring now to FIG. 6, one embodiment of the articulating joint 240 having a first pinion 252 and a second pinion 254 are depicted. In this embodiment, the first pinion 252 may be selectively decoupled from the second pinion 254, thereby allowing the first attachment beam 144 to be articulated freely relative to the second attachment beam 146. The first pinion 252 may be released and may interface with the mating gear surfaces of the second pinion 254, thereby selectively coupling the first pinion 252 with the second pinion 254 and arresting articulation of the first attachment beam 144 relative to the second attachment beam 146 at a plurality of predetermined orientations.

Figure 7:
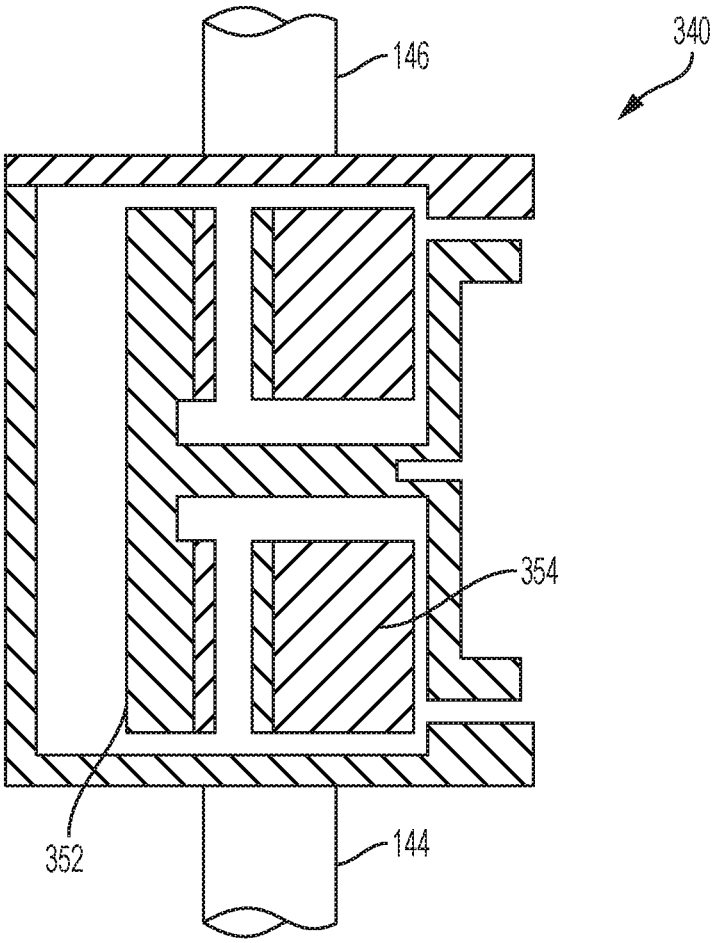
FIG. 7 is a top sectional view of the articulating joint of FIG. 4 shown alone line A-A.

Referring now to FIG. 7, one embodiment of the articulating joint 340 having a first clutch surface 352 and a second clutch surface 354 are depicted. In this embodiment, the first clutch surface 352 may be selectively decoupled from the second clutch surface 354, thereby allowing the first attachment beam 144 to be articulated freely relative to the second attachment beam 146. The first clutch surface 352 may be released and may interface with the second clutch surface 354, thereby selectively coupling the first clutch surface 352 with the second clutch surface 354 and arresting articulation of the first attachment beam 144 relative to the second attachment beam 146 through a plurality of orientations throughout the range of motion of the articulating joint 340.

Figure 8:
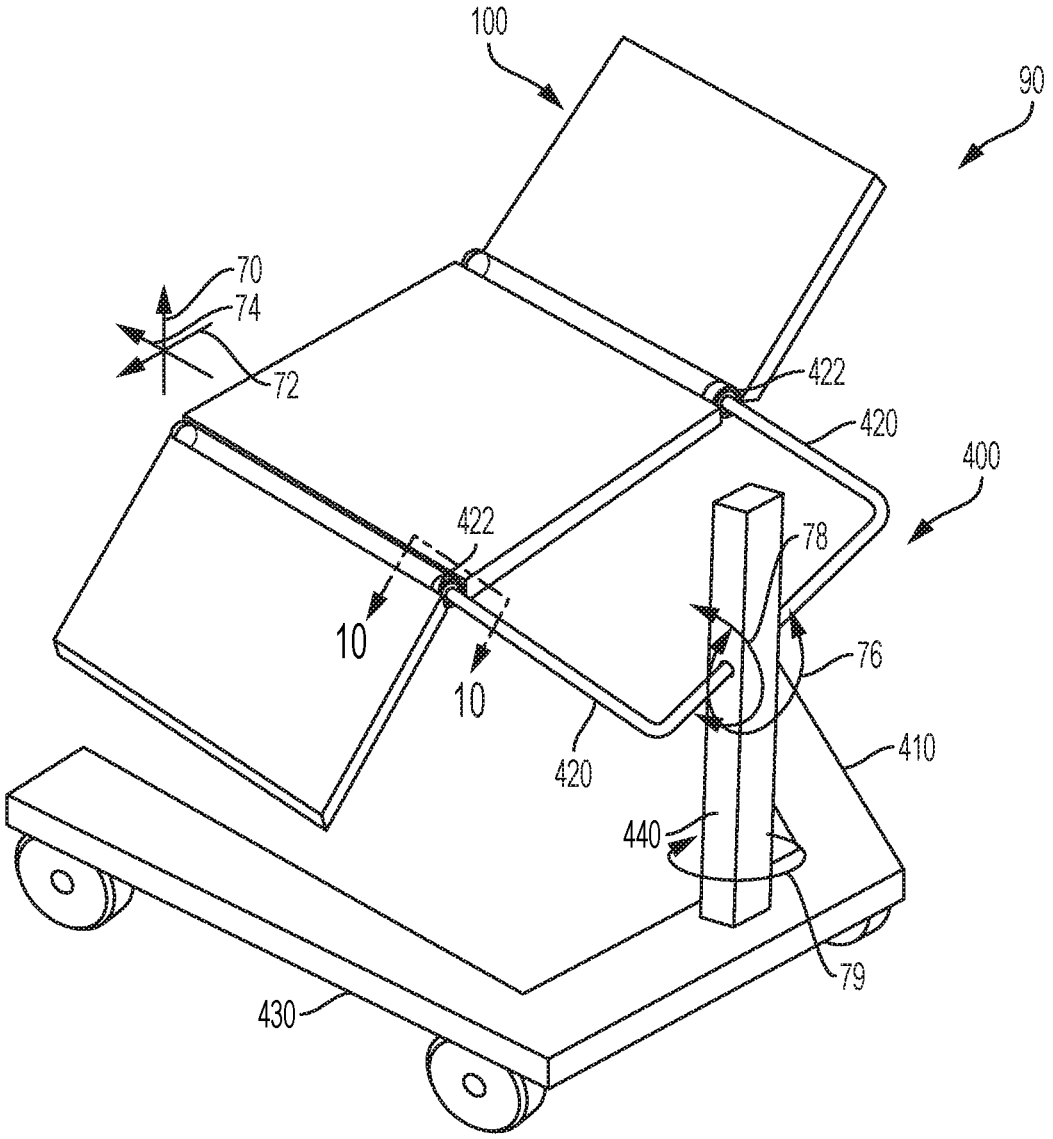
FIG. 8 is a side perspective view of a patient handling system according to one or more embodiments shown or described herein.
Figure 9:
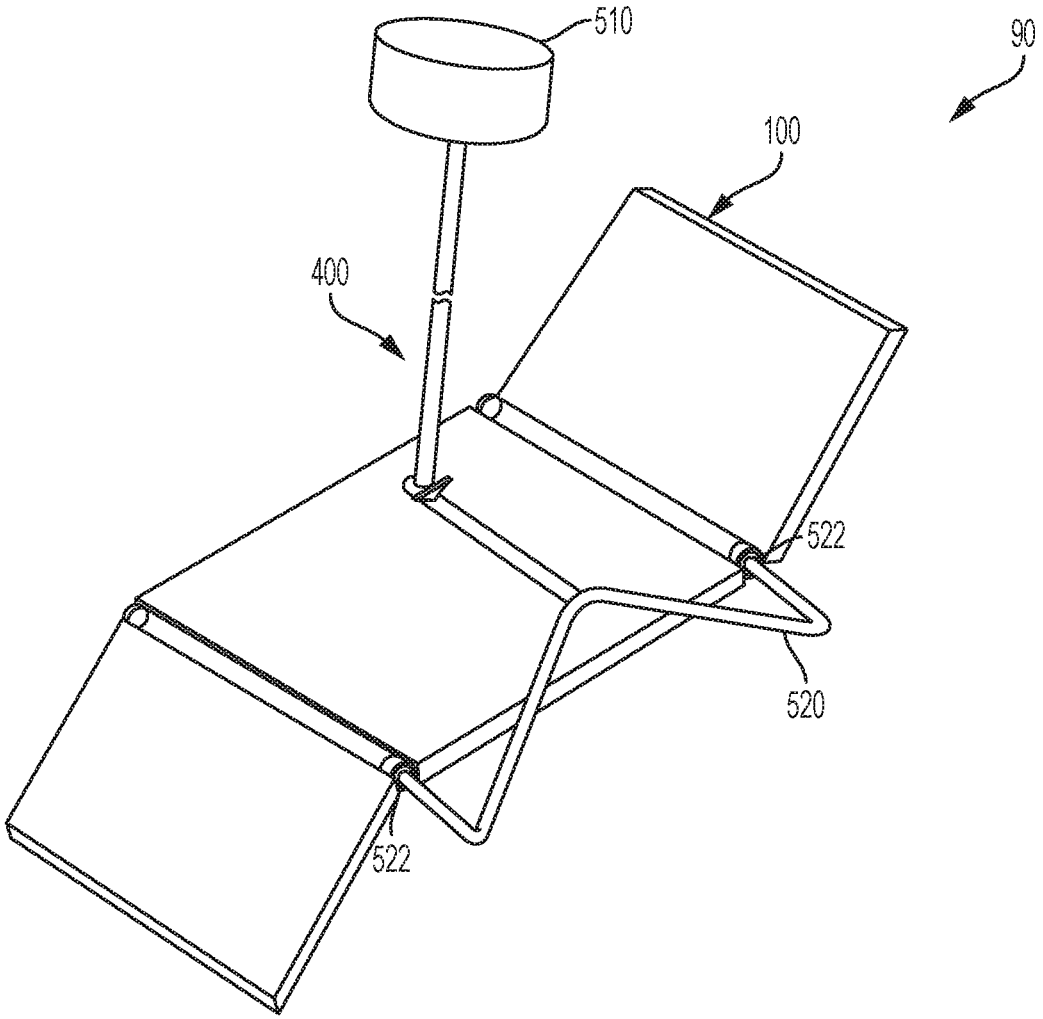
FIG. 9 is a side perspective view of a patient handling system according to one or more embodiments shown or described herein.

Referring to FIGS. 8 and 9, embodiments of the patient handling system 90 that includes the patient handling device 100 and a patient lifting device 400 are depicted. Referring to the embodiment depicted in FIG. 8, the patient lifting device 400 includes a mobile lift 410. The mobile lift 410 may include a plurality of lifting arms 420 that terminate at pins 422 that interface with the patient handling device 100, as will be described below. The mobile lift 410 may include a rolling base 430 and a stanchion 440 that extends from the rolling base 430 and supports the lifting arms 420 of the mobile lift 410.

The lifting arms 420 may be adapted to be moved through a variety of positions and orientations such that the lifting arms 420 may be positioned for proper engagement with the patient handling device 100. In various embodiments, the lifting arms 420 may traverse in a vertical direction 70 relative to the stanchion 440, and may also traverse in a fore-aft direction 72 and a lateral direction 74. The lifting arms 420 may also be oriented in a pitch orientation 76, and may also be oriented in a roll orientation 78 and a yaw orientation 79. In some embodiments, the movement of the lifting arms 420 relative to the stanchion 440 may be limited to only certain directions and orientations. In such embodiments, the patient lifting device 400 may be translated along the ground surface 80 to accommodate any position mismatch between the lifting arms 420 and the patient handling device 100.

The mobile lift 410 may be manually operated or may be robotically operated, and may include, across various embodiments, hydraulic and/or electromechanical actuators to reposition the lifting arms 420 relative to the rolling base 430. In some embodiments, the mobile lift 410 may be manually repositioned throughout a care facility. In other embodiments, the mobile lift 410 may include powered wheels to allow the mobile lift 410 to be driven throughout a care facility.

Referring to the embodiment depicted in FIG. 9, a patient lifting device 400 includes an overhead hoist 510. The overhead hoist 510 may include a lifting frame 520 that is terminated at pins 522 that interface with the patient handling device 100. The lifting frame 520 may be configured to allow the overhead hoist 510 to support the patient handling system at a position that generally corresponds to the center of gravity of the patient and the patient handling device.

The overhead hoist 510 may be operated by hydraulic or electrical actuators, such that a caregiver may selectively raise or lower the lifting frame 520 and, when coupled, the patient handling device 100 with little caregiver effort.

Referring collectively to FIGS. 8 and 9, the patient handling system 90 in general, and the patient handling device 100 in particular, allows for maximum access to the patient while the patient is positioned on the patient handling device 100. This may be important to allow for sensors and catheters, for example, intravenous catheters or uretic catheters, to be maintained in their relative position on the patient with a minimum of disruption. Further, because the patient handling device 100 contacts the patient along a portion of the patient's body, and does not envelop the patient like a conventional sling, the patient may be more comfortable as compared to patients lifted in a conventional sling.

Additionally, because the patient handling device 100 may be configured to generally match that of the patient at the time the patient is positioned on the patient handling device 100, the patient may not be subject to movement or weight re-distribution upon lifting the patient with the patient handling system 90.

Figure 10:
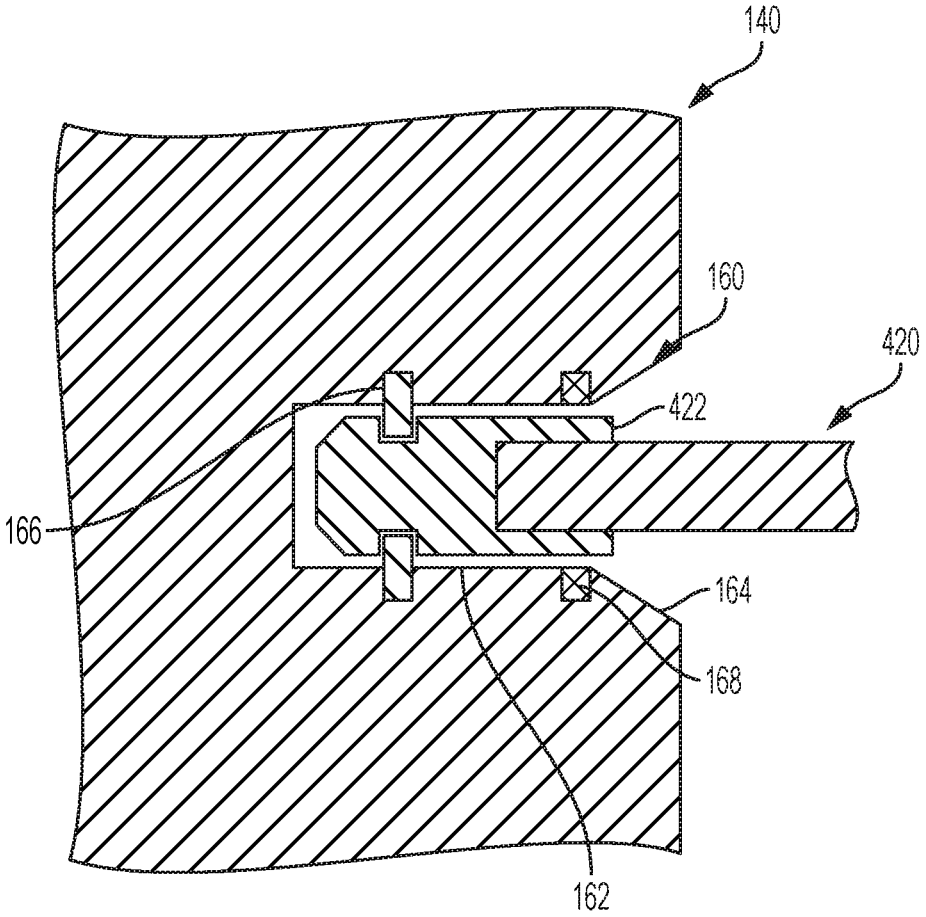
FIG. 10 is a side sectional view of the patient handling system of FIG. 8 shown along line 10-10.

Referring to FIG. 10, the articulating joint 140 may include a lifting point interface 160. The lifting point interface 160 may allow for the articulating joint 140, and therefore the patient handling device, to be selectively coupled to a patient lifting device 400. The lifting point interface 160 allows for the force of the patient and the patient handling device to be transferred to the patient lifting device 400. In the depicted embodiment, the lifting point interface 160 includes a locking orifice 162 having an opening 164 and a locking collar 166. The lifting point interface 160 allows for a pin 422 of the patient lifting device 400 to be inserted into the lifting point interface 160. The locking collar 166 may selectively couple the pin 422 within the locking orifice 162, such that inadvertent removal of the pin 422 from the locking orifice 162 is minimized.

The lifting point interface 160 may include a piloting magnet 168. The pin 422 of the patient lifting device 400 may be magnetically attracted to the piloting magnet 168, such that the piloting magnet 168 attracts the pin 422, thereby encouraging the pin 422 to position itself into the locking orifice 162. The piloting magnet 168, therefore, may assist with coupling of the patient handling device 100 to the patient lifting device 400.

While the orientation of the lifting point interface 160 on the articulating joint 140 is shown in one orientation, it should be understood that the lifting point interface 160 may be positioned across a variety of locations on the lifting point interface 160. The articulating joints 140, therefore, may engage with patient lifting devices 400 having pins 422 that are configured in various locations and orientations. For example, FIGS. 8 and 9 depict pins 422 that project into the respective lifting point interfaces 160 in a generally horizontal orientation. However, other patient lifting devices (not shown) may include pins that project in a generally upwards vertical direction or a generally downwards vertical direction. The articulating joints may include lifting point interfaces that are configured to accept such pins so that the pins may be engaged with the lifting point interfaces of the respective articulating joints.

In some embodiments, the articulating joint 140 may include engagement verification elements (not shown) that indicate to a caregiver whether the pin 422 of the patient lifting device 400 is engaged with the lifting point interface 160. In various embodiments, the engagement verification elements may provide visual, audible, or haptic feedback to the caregiver, for example, by displaying a color on the articulating joint 140 that indicates engagement or disengagement; playing a tone or a series of tones that indicate engagement or disengagement; or extending or retracting an external-facing surface of the articulating joint 140 to indicate engagement or disengagement of the pin 422 with the lifting point interface 160.

It should now be understood that patient handling devices according to the present disclosure may include a support member, a torso support member, and a lower extremities support member, where the various support members are coupled to one another by articulating joints. The articulating joints are selectable to arrest or allow articulation of the respective members relative to one another to allow the patient handling device to be oriented throughout a variety of configurations to accommodate patients positioned in a variety of postures. Patient handling devices according to the present disclosure may allow for patients to be easily and securely moved throughout a care facility.

According to a first embodiment, a patient handling device may include a support member, a torso support member, and at least one articulating joint coupled to the support member and the torso support member, where the at least one articulating joint is selectable to arrest or allow articulation of the torso support member relative to the support member.

According to a second embodiment, a patient handling system may include a patient handling device having a support member, a torso support member, a lower extremities support member, at least one articulating joint coupled to the support member and the torso support member, and at least one articulating joint coupled to the support member and the lower extremities support member. The patient handling system may further include a patient lifting device that is selectively coupled to at least two articulating joints of the patient handling device.

According to a third embodiment, the patient handling device according to the first embodiment may further include a lower extremities support member and at least one articulating joint coupled to the support member and the lower extremities support member, where the at least one articulating joint is selectable to arrest or allow articulation of the lower extremities support member relative to the support member.

According to a fourth embodiment, the patient handling device according to any of the first through third embodiments may include at least one articulating joint that includes a selectively locking hub, a first attachment beam that extends from the selectively locking hub, and a second attachment beam that extends from the selectively locking hub, where the first attachment beam is coupled to the support member and the second attachment beam is coupled to the torso support member.

According to a fifth embodiment, the patient handling device according to the fourth embodiment may include a selectively locking hub that includes a plurality of preselected orientations through which the first attachment beam is oriented relative to the second attachment beam.

According a sixth embodiment, the patient handling device according to the fifth embodiment may include a selectively locking hub that includes a plurality of detents and a catch that is selectively positioned in the detents.

According a seventh embodiment, the patient handling device according to the fifth embodiment may include a selectively locking hub that includes a first pinion and a second pinion that are selectively engaged with one another.

According an eighth embodiment, the patient handling device according to the fifth embodiment may include a selectively locking hub that includes a selectively engageable clutch.

According to a ninth embodiment, the patient handling device according to any of the fourth to eighth embodiments may include an articulating joint that includes a lifting point interface.

According to a tenth embodiment, the patient handling device according to the ninth embodiment may include a lifting point interface that includes a locking orifice.

According to an eleventh embodiment, the patient handling device according to the ninth embodiment may include a locking orifice that includes a piloting magnet.

According to a twelfth embodiment, the patient handling device according to any of the fourth to eleventh embodiments may include a first articulating joint and a second articulating joint coupled to the support member and the torso support member and a third articulating joint and a fourth articulating joint coupled to the support member and the lower extremities support member.

According to a thirteenth embodiment, the patient handling device according to any of the second to twelfth embodiments may include side supports that are coupled to at least one of the support member or the torso support member.

According to a fourteenth embodiment, the patient handling device according to the thirteenth embodiment may include side supports coupled to the lower extremities support member.

According to a fifteenth embodiment, the patient handling device according to any of the first to fourteenth embodiments may include the support member and the torso support member being separable from one another.

According to a sixteenth embodiment, the patient handling device according to any of the first to fifteenth embodiments may include the lower extremities support member and the support member being separable from one another.

It is noted that recitations herein of "at least one" component, element, etc., should not be used to create an inference that the alternative use of the articles "a" or "an" should be limited to a single component, element, etc.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. A patient handling device, comprising:

a support member;

a torso support member;

at least one articulating joint coupled to the support member and the torso support member, wherein the at least one articulating joint is selectable to arrest or allow articulation of the torso support member relative to the support member; and a lifting point interface formed within the at least one articulating joint and configured to receive a lifting pin of a patient lifting device in a coaxial arrangement.

2. The patient handling device of claim 1, further comprising:

a lower extremities support member; and at least one articulating joint coupled to the support member and the lower extremities support member, wherein the at least one articulating joint is selectable to arrest or allow articulation of the lower extremities support member relative to the support member.

3. The patient handling device of claim 1, wherein the at least one articulating joint comprises:

a selectively locking hub;

a first attachment beam that extends from the selectively locking hub; and a second attachment beam that extends from the selectively locking hub, wherein the first attachment beam is coupled to the support member and the second attachment beam is coupled to the torso support member.

4. The patient handling device of claim 3, wherein the selectively locking hub comprises a plurality of pre-selected orientations through which the first attachment beam is oriented relative to the second attachment beam.

5. The patient handling device of claim 4, wherein the selectively locking hub comprises a plurality of detents and a catch that is selectively positioned in the detents.

6. The patient handling device of claim 4, wherein the selectively locking hub comprises a first pinion and a second pinion that are selectively engaged with one another.

7. The patient handling device of claim 3, wherein the selectively locking hub comprises a selectively engageable clutch.

8. The patient handling device of claim 1, wherein the lifting point interface comprises a locking orifice.

9. The patient handling device of claim 8, wherein the locking orifice comprises a piloting magnet.

10. The patient handling device of claim 3, wherein the patient handling device comprises:

a first articulating joint and a second articulating joint coupled to the support member and the torso support member; and a third articulating joint and a fourth articulating joint coupled to the support member and the lower extremities support member.

11. The patient handling device of claim 2, further comprising side supports coupled to at least one of the support member or the torso support member.

12. The patient handling device of claim 11, further comprising side supports coupled to the lower extremities support member.

13. The patient handling device of claim 1, wherein the support member and the torso support member are separable from one another.

14. The patient handling device of claim 2, wherein the lower extremities support member and the support member are separable from one another.

15. A patient handling system, comprising:

a patient handling device, comprising:

a support member;

a torso support member;

a lower extremities support member;

a first articulating joint coupled to the support member and the torso support member; and a second articulating joint coupled to the support member and the lower extremities support member, wherein each of the first articulating joint and the second articulating joint comprise a lifting point interface comprising a piloting magnet positioned within the lifting point interface; and a patient lifting device comprising a first lifting pin and a second lifting pin, wherein the first lifting pin and the second lifting pin are magnetically attracted to the piloting magnet such that the first and second lifting pins are attracted into the first and second lifting point interfaces via the piloting magnet.

16. The patient handling system of claim 15, wherein the patient lifting device comprises a mobile lift.

17. The patient handling system of claim 15, wherein the patient lifting device comprises a hoist.

18. The patient handling system of claim 15, wherein:

the first lifting pin and the second lifting pin of the patient lifting device are selectively engaged with the lifting point interface of the articulating joints in a coaxial arrangement.

19. The patient handling system of claim 15, wherein the patient handling device and the patient lifting device are configured to support a patient in all of a supine position, an upright sitting position in which the support member is generally parallel to a ground surface, and a reclined sitting position in which the support member is transverse to the ground surface.

* * * * *